US007318542B2

(12) United States Patent
Godshaw et al.

(10) Patent No.: US 7,318,542 B2
(45) Date of Patent: Jan. 15, 2008

(54) TOOL BELT CARRIER, AND POUCH CONSTRUCTIONS

(75) Inventors: Donald E. Godshaw, Evanston, IL (US); Andrezj M. Redzisz, Wheeling, IL (US)

(73) Assignee: Travel Caddy, Inc., Elk Grove Village, IL (US)

( * ) Notice: Subject to any disclaimer, the term of this patent is extended or adjusted under 35 U.S.C. 154(b) by 0 days.

(21) Appl. No.: 11/301,124

(22) Filed: Dec. 12, 2005

(65) Prior Publication Data

US 2006/0086769 A1 Apr. 27, 2006

Related U.S. Application Data

(60) Division of application No. 10/813,524, filed on Mar. 30, 2004, now Pat. No. 7,011,241, which is a continuation of application No. 10/339,902, filed on Jan. 10, 2003, now Pat. No. 6,712,251, which is a division of application No. 09/921,125, filed on Aug. 2, 2001, now abandoned, which is a continuation-in-part of application No. 09/359,339, filed on Jul. 21, 1999, now Pat. No. 6,390,348.

(60) Provisional application No. 60/222,713, filed on Aug. 3, 2000.

(51) Int. Cl.
*A45C 1/04* (2006.01)

(52) U.S. Cl. ..... 224/674; 224/627; 224/637; 224/648; 224/649; 224/259; 224/579

(58) Field of Classification Search ..... 224/605, 224/904, 627, 637, 648, 649, 259, 579; D3/238
See application file for complete search history.

(56) References Cited

U.S. PATENT DOCUMENTS

| | | | | | |
|---|---|---|---|---|---|
| 1,511,259 | A * | 10/1924 | Braden | 224/643 |
| 4,923,105 | A * | 5/1990 | Snyder | 224/255 |
| 4,962,873 | A * | 10/1990 | Schattel | 224/665 |
| D316,485 | S * | 4/1991 | Seber | D3/228 |
| 5,630,536 | A * | 5/1997 | Bugnaski | 224/600 |
| 5,947,241 | A * | 9/1999 | Rausch | 190/108 |
| 6,179,185 | B1 * | 1/2001 | Dancyger | 224/576 |
| 6,561,402 | B2 * | 5/2003 | Holland et al. | 224/677 |

* cited by examiner

*Primary Examiner*—Tri M. Mai
(74) *Attorney, Agent, or Firm*—Banner & Witcoff, Ltd.

(57) ABSTRACT

A low slung tool belt carrier includes pouches designed to be suspended from a belt strap construction with a shoulder strap crossing over the torso or shoulders to support the larger of two pouches, the pouches arranged to fit on the hips or be rested upon the hips of an individual. Alternate constructions incorporate handles for carrying the pouches and fasteners for combining pouches. Various alternative combinations of tool belts, waist straps, handles, carry straps, pouches and pockets enable customization of a tool belt for individual workmen.

10 Claims, 12 Drawing Sheets

FIG.19
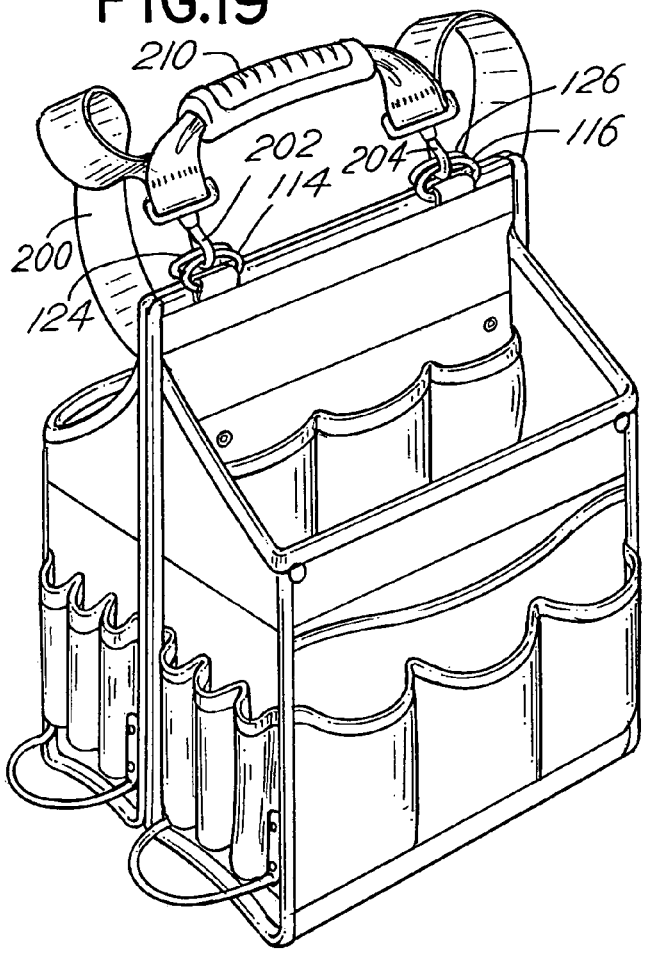
FIG.21
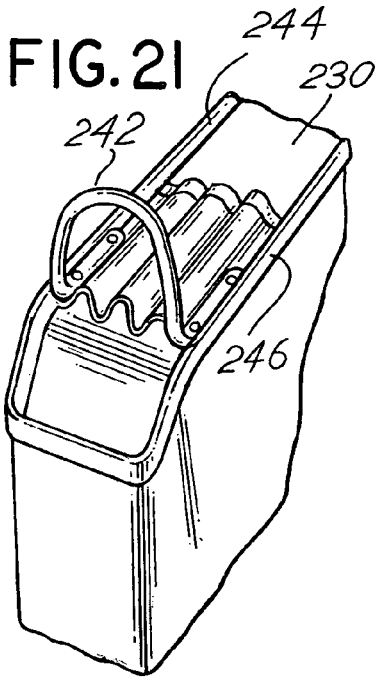
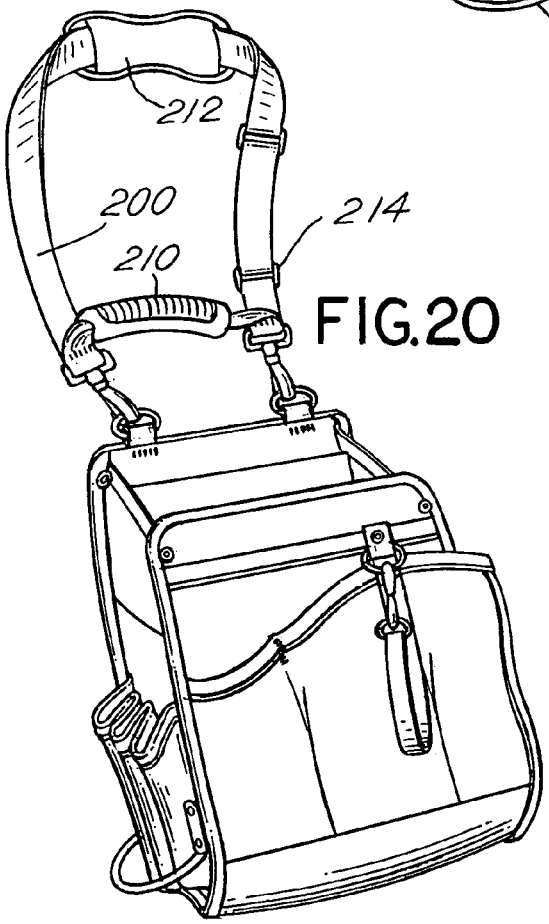
FIG.20
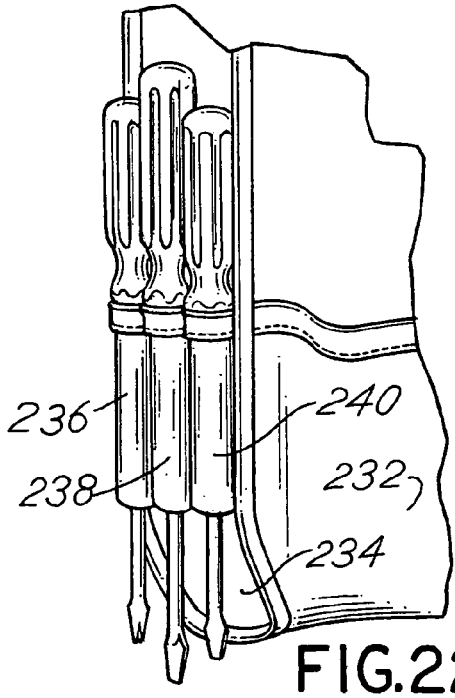
FIG.22

TOOL BELT CARRIER, AND POUCH CONSTRUCTIONS

CROSS REFERENCE TO RELATED APPLICATIONS

This is a division of Ser. No. 10/813,524 filed Mar. 30, 2004 now U.S. Pat. No. 7,011,241 for "Tool Belt Carrier, and pouch Constructions", which is a continuation of Ser. No. 10/339,902 filed Jan. 10, 2003 for "Low Slung Tool Carrier", now U.S. Pat. No. 6,712,251 issued Mar. 30, 2004, which is a division of Ser. No. 09/921,125 filed Aug. 2, 2001 for "Low Slung Tool Carrier" (abandoned) which is a continuation in part of Ser. No. 09/359,339 filed Jul. 21, 1999 for "Tool Belt" (now issued as U.S. Pat. No. 6,390, 348), and provisional application Ser. No. 60/222,713 filed Aug. 3, 2000 for "Low Slung Tool Carrier" (abandoned) all of which are incorporated herewith by reference and for which priority is claimed.

BACKGROUND OF THE INVENTION

In a principal aspect the present invention relates to a tool belt and, more particularly, to a tool belt of the type which includes a number of storage pockets and adjustable belt support members.

Construction workers, tradesman and the like typically use a tool belt attached about their waist to transport and maintain tools at a work site. Such belts are often fabricated from canvas and/or leather and may include a number of pockets or pouches which are designed to hold tools such as pliers, screwdrivers and the like. Desirable characteristics for such belts are durability and the capability to hold and store many tools and other items. The belts must also be comfortable and yet durable in order to withstand rugged circumstances. Additionally, such a belt must be designed to accommodate various types of tools and if possible permit alteration and adjustment in order to accommodate various types of tools, various sizes of tools and various sizes of workmen. Thus, there has remained a need for an improved tool belt which is comfortable to wear, rugged, economical and easily adapted for multiple uses.

SUMMARY OF THE INVENTION

Briefly, in one embodiment, the invention comprises a tool carrier which includes an adjustable strap or belt having first and second tool pockets or pouches affixed thereto and spaced one from the other by a distance which enables the pouches to rest comfortably on the opposite hips of a user of the tool belt. A shoulder strap, which is designed to cross over the torso of an individual, has opposite ends connected adjacent the opposite sides of one of the pockets, preferably the larger of the storage pockets. The belt may thus rest upon the hips of an individual with a larger pocket resting on one hip and with a shoulder strap supporting the larger pocket by crossing the torso and extending over one shoulder on one side of the individual to the pocket on the opposite side of the individual. Alternative constructions include first and second shoulder straps connected to opposite sides of the front of the belt attached to a single strap that extends down the back of an individual and is then connected to the belt or tool carrier waist strap.

Additional embodiments of the invention combine a belt with pouches attached to loops along the top margin of the pouches for attachment of the pouches to the belt. The pouches may also include buckles along the top margin which are adapted to receive shoulder straps. Handles may also be attached to the belt so that when the belt is folded, the belt and attached pouches may be carried by the handles which overlap with one another.

Alternatively, the belt may be used in combination with a waist strap wherein the handles are attached to the waist strap. The belt thus is attached to or extended through belt loops on the waist strap. In another embodiment the belt is attached to the pouches by stitching and handles are also attached to the belt strap or the pouches by stitching. The pouches may be formed with a reinforcing wire around the top edge or top margin of the pouches with the wire projecting, at its midpoint, above the ends so that when tools or items are placed in the pouches and the pouches are weighted down and deformed or sagging, the contents of the pouch will not spill. The pouches, which are removable from the belt, may include hook and loop materials on their back side so that the pouches may be aligned and connected together back to back with the loops or buckles aligned along the top margin of the pouches for attachment to a carry strap. Various designs are depicted for attachment of the pouches to a belt. Various types of carry straps are depicted for carrying pouches which are joined back to back. The pouches also may include special pockets wherein the sides of the pouches are formed in a manner that will not interfere with the extended shaft of a tool such as a pick or screwdriver.

Thus it is an object of the invention to provide an improved tool carrier.

It is a further object of the invention to provide a tool carrier which incorporates a tool belt in combination with the various types of shoulder straps and tool pockets or pouches.

Another object of the invention is to provide a tool carrier which may be "low slung" or in other words, supported on the hips of an individual.

Another object of the invention is to provide a tool carrier made from a flexible yet rugged material such as leather, canvas or other flexible fabric materials.

A further object of the invention is to provide a tool carrier which is capable of having tool pockets positioned on the left and right hand side of an individual, preferably over the hips, with a supplemental shoulder strap(s) either crossing the torso or fitting over the shoulders of an individual and a single strap extending down the back of an individual connected to the tool belt.

Yet another object of the invention is to provide a tool carrier which permits adjustment of the position of tool pockets suspended from a tool belt Another object of the invention is to provide alternative designs for tool belts including designs wherein the tool belt and tool belt pockets may be converted into or utilized as discrete pouches for tools or combinations of pouches with handles and/or straps to facilitate transport of the pouches.

A further object of the invention is to provide tool pouch constructions which prevent or seek to prevent collapse of tool storage pouch pockets due to the weight and/or configuration of tools placed in such pockets.

Another object of the invention is to provide for tool pouches which may be attached together or which may be attached to a tool belt.

These and other objects, advantages and features of the invention are set forth in the detailed description which follows.

BRIEF DESCRIPTION OF THE DRAWING

In the detailed description which follows reference will be made to the drawing comprised of the following Figures:

FIG. 19 is an isometric view illustrating the combination of a pair of pouches of the type shown in FIG. 14 with a strap and handle which is attached to the joined pouches for carrying those pouches in the form of a tool carrier;

FIG. 20 is an isometric view of a single pouch of the type depicted in FIG. 14 in combination with a carrier strap and handle of the type also used and depicted in FIG. 19;

FIG. 21 is an isometric view of the combination of pockets particularly designed for carrying the tools such as a hammer and elongated shaft tools, such as screwdrivers;

FIG. 22 is an enlarged isometric view of the elongated shaft tool pockets associated with a pouch of the type depicted in FIG. 21;

DESCRIPTION OF THE PREFERRED EMBODIMENTS

Figure 2:
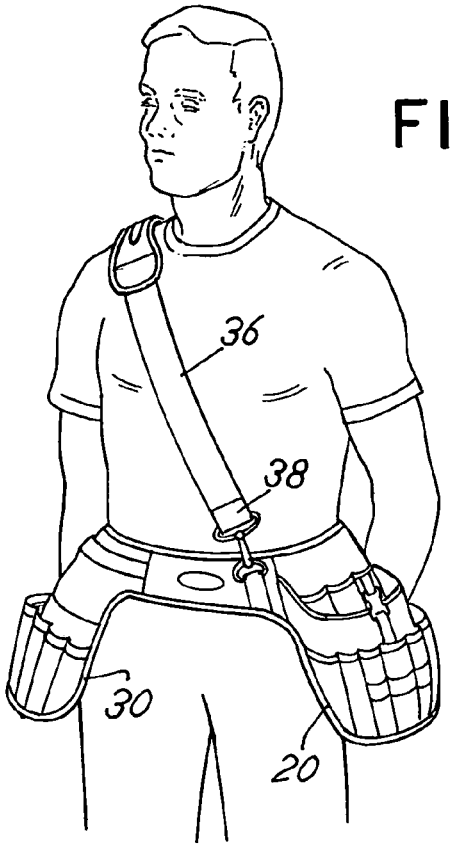
FIG. 2 is an isometric view of the tool carrier of the invention as it is worn by a person.

In the embodiment of FIGS. 1 through 4 the tool carrier comprises a belt or waist strap 10 having a first end 12 and a second end 14. The ends 12 and 14 include fasteners, such as buckles 13, 15 which permit the ends 12, 14 to be attached one to the other. The fasteners 13, 15 are such that the length or the waist dimension of strap 10 may be altered depending upon the particular person or worker who is wearing the tool carrier and the position of the belt about the torso. The strap 10 further includes an upper margin 16 and a lower margin 18. A first set of pockets or pouch 20 comprises an extension of the lower margin 18 and includes multiple pockets such as pockets 22 and 24 for receiving and storing tools on other items. A support strap 26 is attached to strap 10 adjacent one side of pouch 20 to hold pouch 20 in a condition which provides support and enables retention of tools therein. The first pouch 20 is adjacent to the second end 14 of the strap 10. A second pouch 30 also extends downwardly from the lower margin 18 and includes pockets, for example, pocket 32 for additional tools. First pouch 20 and second pouch 30 are separated by length 19 of strap 10 so that pouches 20, 30 fit respectively over a hip of a worker.

A shoulder strap 36 includes a first end 38 which is attached by means of a buckle 40 to a ring 42 attached to strap 10 adjacent the inner end 25 of the pouch 20 thereby permitting rotational adjustment of the strap 36. The shoulder strap 36 further includes an adjustable, medial shoulder pad 44. A second end 46 of the strap 36 is attached adjacent the second end 14 of the waist strap 10 and adjacent pouch 20 opposite inner end 25. The strap 36 is adjustable in length in the preferred embodiment and includes an overlapping section 48 of the strap 36 that may be adjusted with respect to the buckle 40.

All the straps and pouches are made from a flexible fabric material. When being utilized, the tool carrier strap 10 is positioned around the waist of the individual in a manner which enables strap 10 to rest upon the hips of such the individual, as shown in FIG. 2, with pouches 20, 30 aligned with each hip. The strap 36 is then adjusted and placed across the shoulder of the individual. Note that the first end 38 of the strap 36 is between the first pouch 20 and the second pouch 30, though in closer proximity to the first pouch 20. The ends of the strap 36 are positioned approximately an equal distance from the opposite sides of the first pouch 20 to facilitate support of the larger first pouch 20 by arranging the strap 36 to extend diagonally across the torso of the individual carrying the tool carrier.

Figure 1:
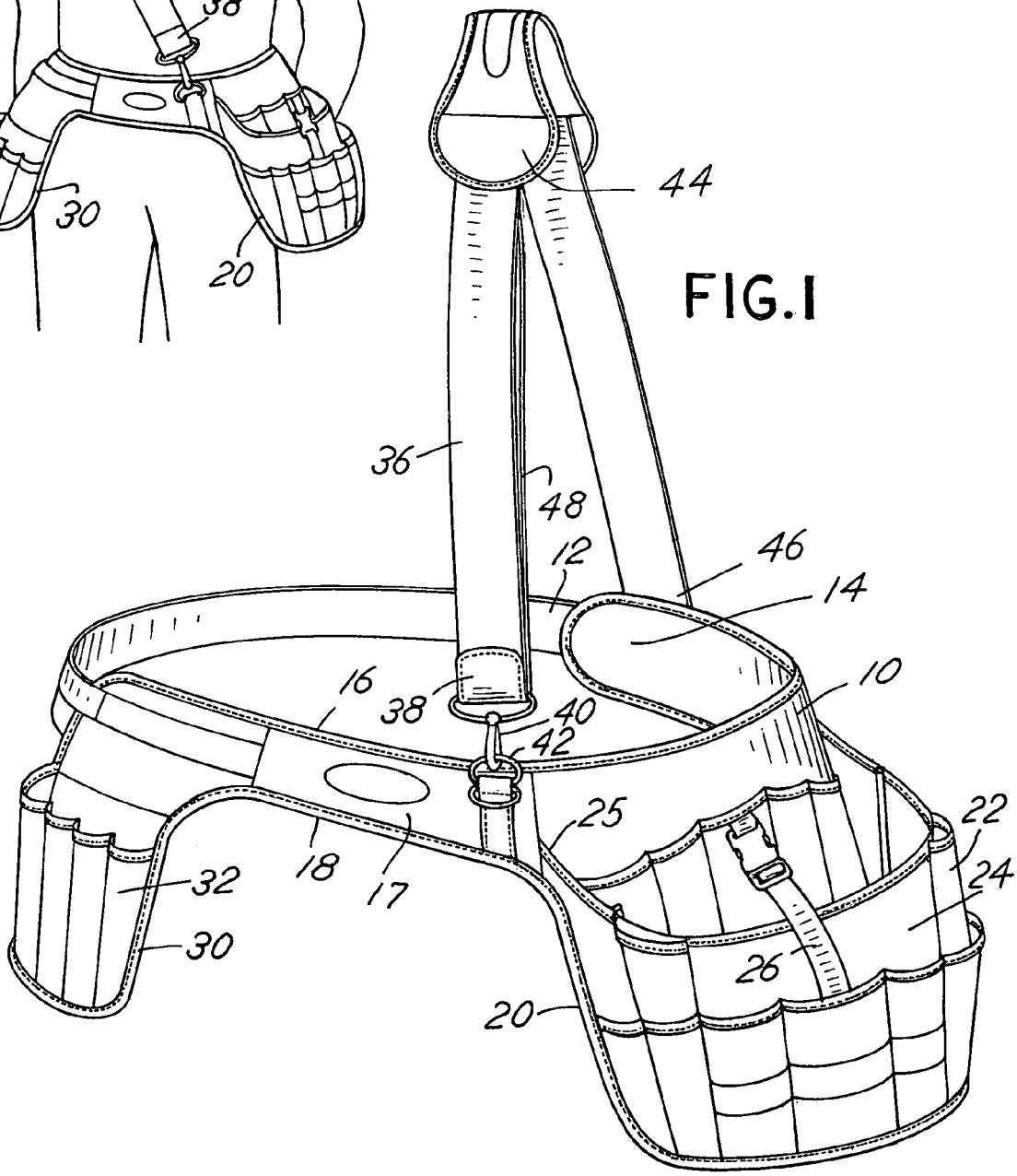
FIG. 1 is an isometric view of the tool carrier of the invention.
Figure 3:
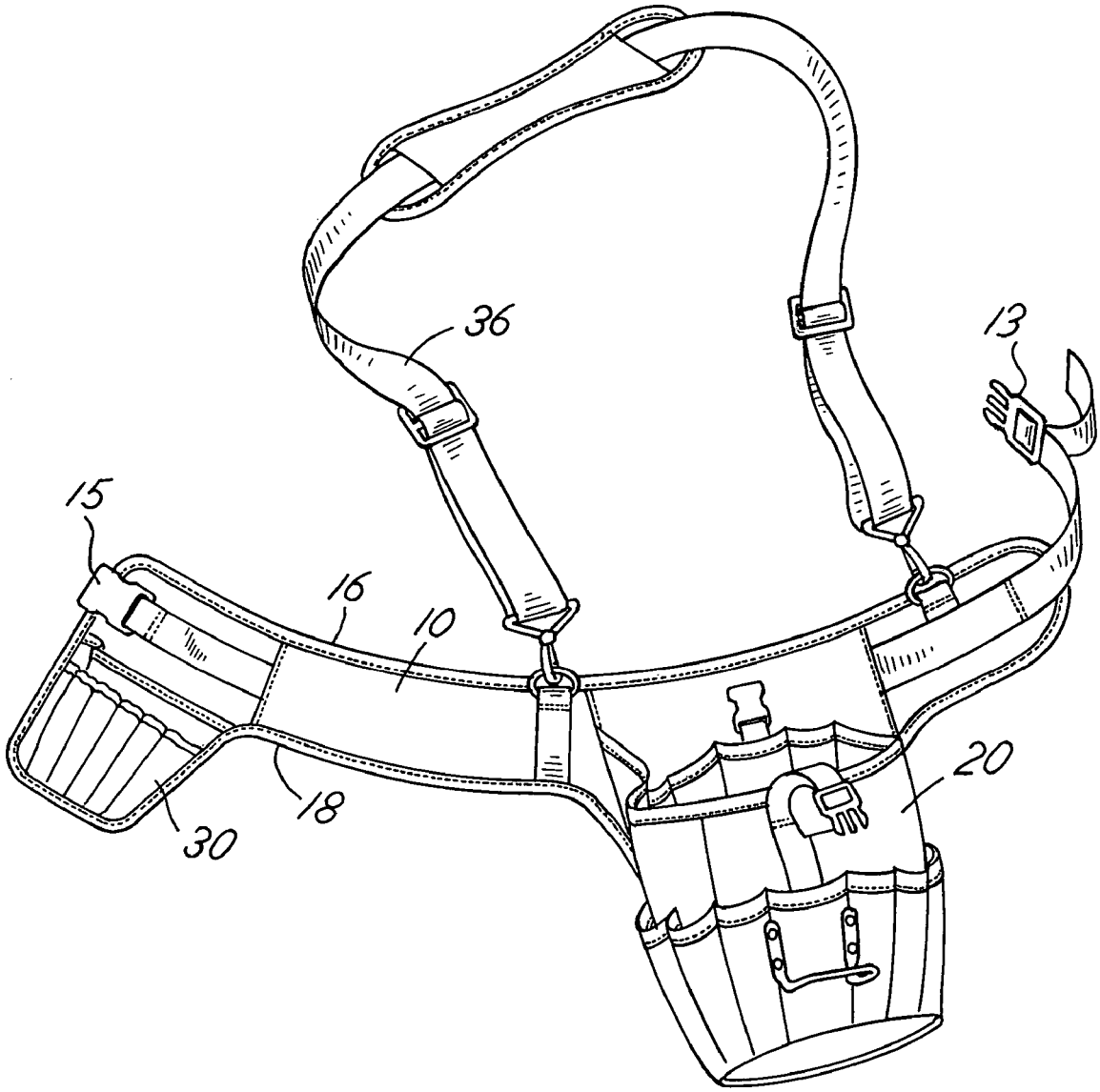
FIG. 3 is a plan view of the tool carrier of FIG. 1.

FIG. 3 depicts the embodiment of FIGS. 1 and 2 with the buckle 13, 15 for connecting the strap 10 detached and further depicting the shoulder strap 36 arranged with its connections to the strap 10 on opposite sides of the oversized or larger pouch 20. The pouch 20 is a larger pouch relative to the pouch 30 in as much as the pouch 20 rests upon the hip of an individual and is supported by the shoulder strap 36 which fits over on the shoulder of an individual and crosses the torso as depicted in FIG. 2.

Figure 4:
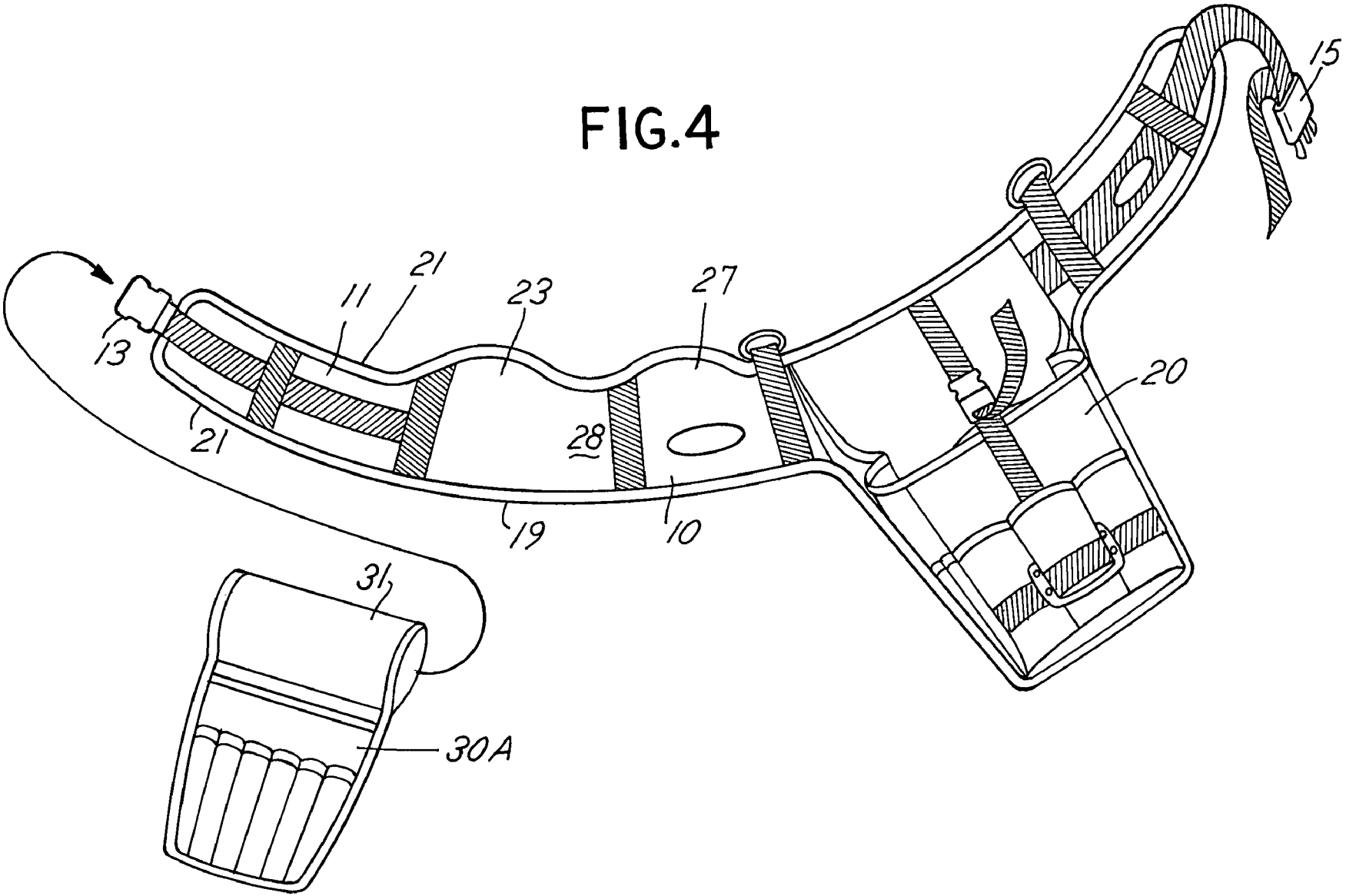
FIG. 4 is a plan view of an alternative construction of the belt and pockets similar to the embodiment depicted in FIGS. 1 and 2.

FIG. 4 illustrates an alternative embodiment of the construction of FIG. 3. The strap 10 does not include an integral pouch 30 but includes a replaceable pouch 30A in FIG. 4 which may slide or fit over the strap 10. Specifically a sleeve 31 is provided for the pouch 30A so that the sleeve 31 may fit over the end section 11 of the strap 10. Further, the strap 10 includes a straight width lower margin 19 and a straight upper margin 21 for section 11 with a first wide section 23 and a lesser width section 25 connected with a second wide section 27 for placement over the backside of an individual. The construction for the tool belt of FIG. 4 may thus be arranged so that the larger pouch 20 will fit on the right hand hip of an individual and the smaller pouch 30A will fit on the left hand hip with the strap 10 arranged around the back side of the individual so that the wider sections 23 and 27 will fit on opposite sides of the spine of an individual with the narrower strap section 25 aligned over the spine of an individual. This arrangement promotes the comfort of the belt when worn by an individual.

Figure 5:
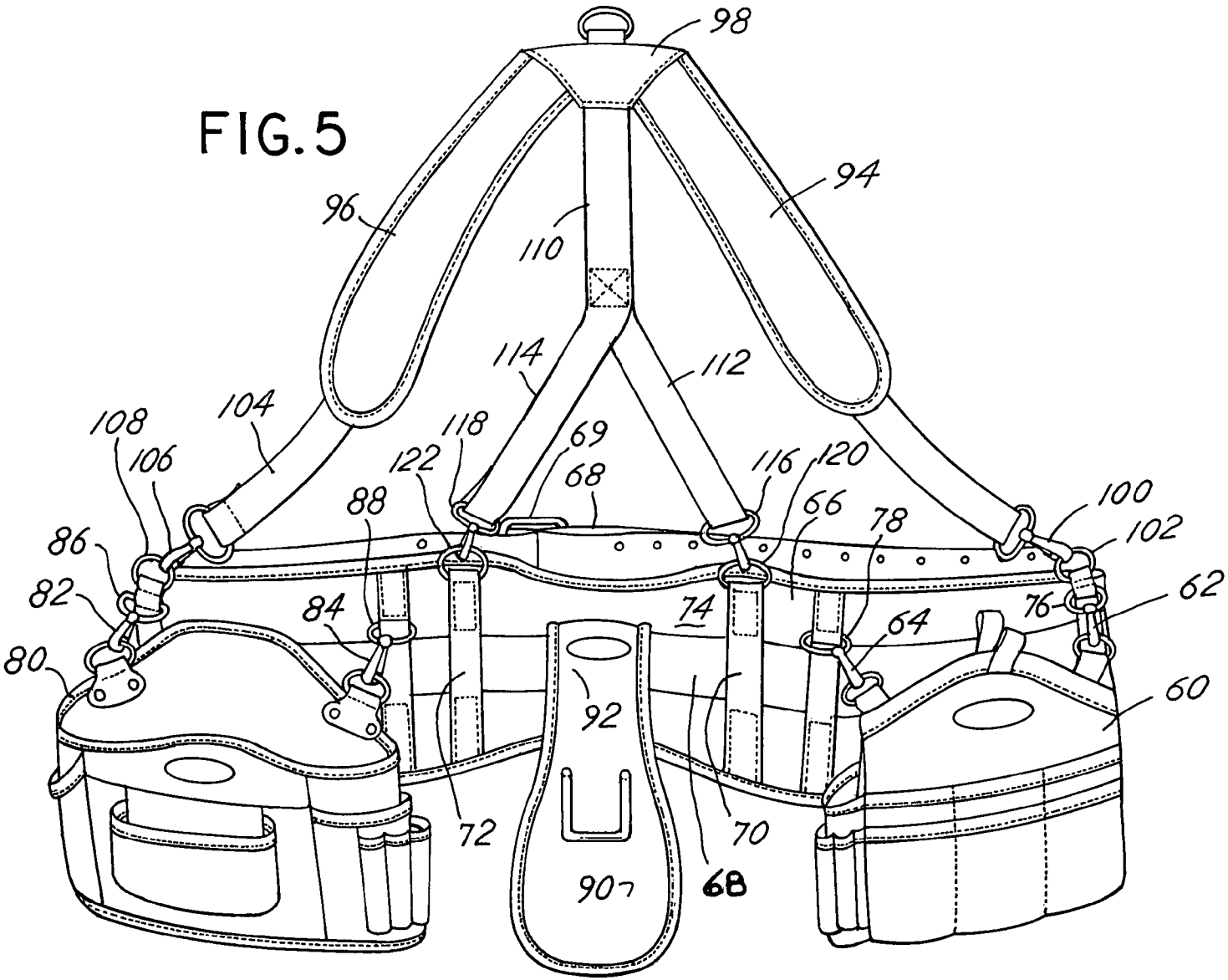
FIG. 5 is an alternative embodiment of a tool carrier incorporating dual shoulder straps.

FIGS. 5 through 8 illustrate two further embodiments of the invention wherein additional shoulder straps are provided for additional support of heavier tools on both hips and for a circumstance wherein large tool pouches are provided that fit over both hips or opposite sides of an individual wherein the pockets are generally equal size and will bear or hold equal weights of tools or other items. Referring therefore to FIG. 5, a first removable pouch 60 is attached by buckles 62 and 64 to a strap 66. The strap 66 will encircle the waist of an individual and includes a connecting belt 68. In the embodiment shown the strap 66 thus includes a series of loops, for example, loops 70 and 72 which receive a belt 68 that encircles the outside face 74 of the strap 66 and connects together by virtue of the belt buckle 69 around the waist or midsection of an individual.

The pouch 60 is attached to metal loops, such as loop 76 and 78, attached to the main strap 66. A second pouch 80 is similarly attached by means of buckles 82 and 84 to metal loops 86 and 88 attached to the strap 66. Note that with this construction the size and configuration of pouches 60 and 80 may be altered or changed as desired. Additionally, in as much as the belt 68 is provided additional items such as tool holder 90 supported by a loop 92 may be held on the strap 66 by the belt 68.

The embodiment of FIG. 5 includes a double shoulder strap comprising a left hand shoulder strap 94 and a right hand shoulder strap 96 which extend respectively from a yoke 98. Strap 94 is adjustably connected to a buckle 100 that is affixed to a metal loop 102 attached to the strap 66. In a similar fashion the right hand strap 96 is attached to an extension 104 that is attached by a buckle 106 to a metal loop 108 attached to the strap 66.

The yoke 98 connects with a single downwardly extending strap 110 that connects with divergent support straps 112 and 114. The straps 112 and 114 are affixed by a buckle 116 and 118 respectively to loops 120 and 122 attached to the strap 66. The right hand shoulder strap 94 thus fits over the right shoulder of an individual. The left hand strap 96 fits over the left shoulder of an individual and the back strap 110 fits down the back along the spine of an individual. All the straps and buckles are adjustable to provide the most appropriate balance and distribution of weight.

Figure 6:
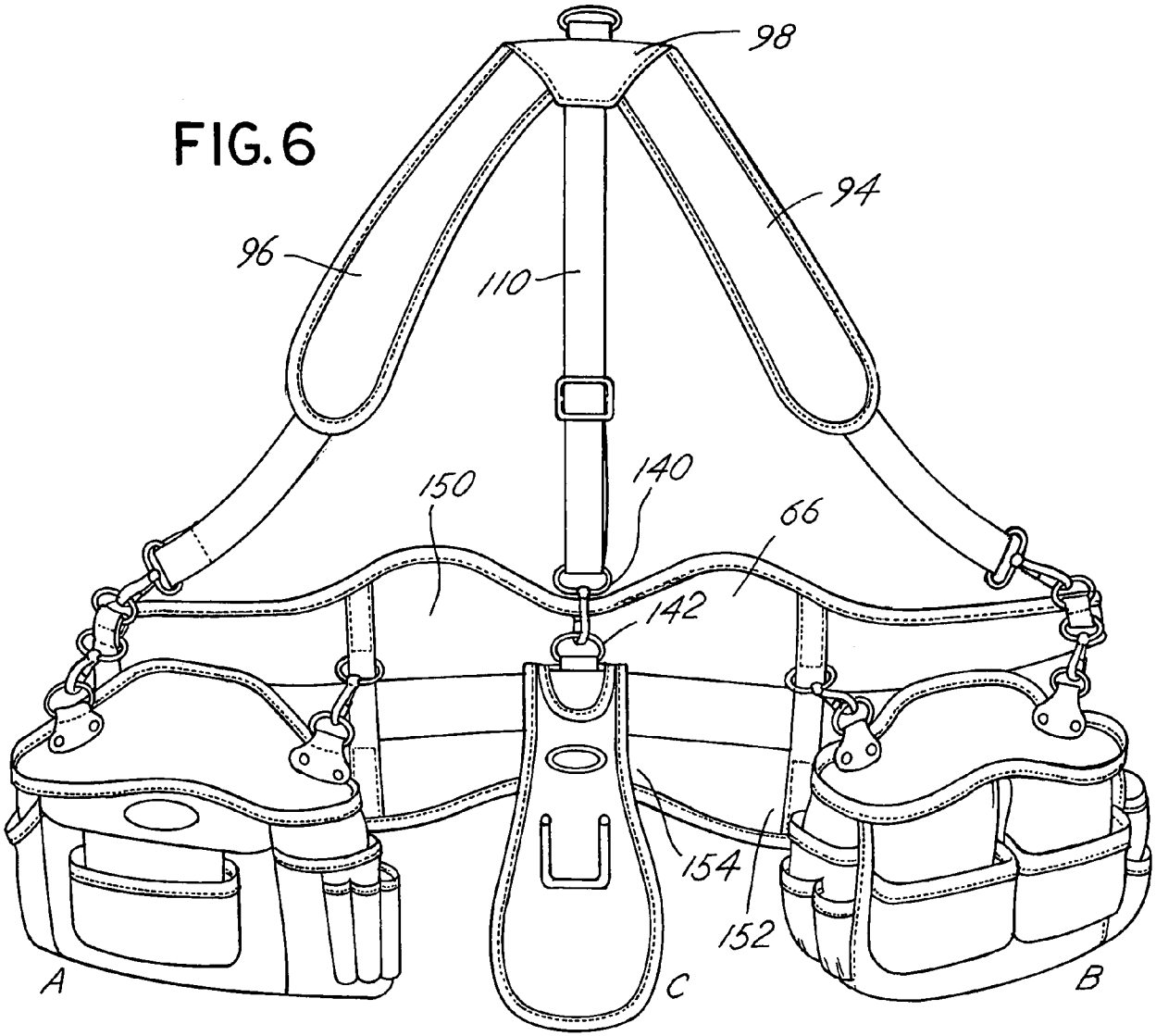
FIG. 6 is an alternative embodiment of a tool carrier incorporating dual shoulder straps and a single back strap.

FIG. 6 illustrates an alternative to the embodiment of FIG. 5. In FIG. 6, the construction is substantially identical to that of FIG. 5 except that the right shoulder strap 94 and the left shoulder strap 96 are connected to a yoke 98 that extends and connects with a single back strap 110 that is adjustable and connected by means of a single buckle 140 to a single metal loop 142 attached to the midpoint of strap 66. The strap 110 thus extends downwardly along the spine of an individual and is adjustable.

Figure 7:
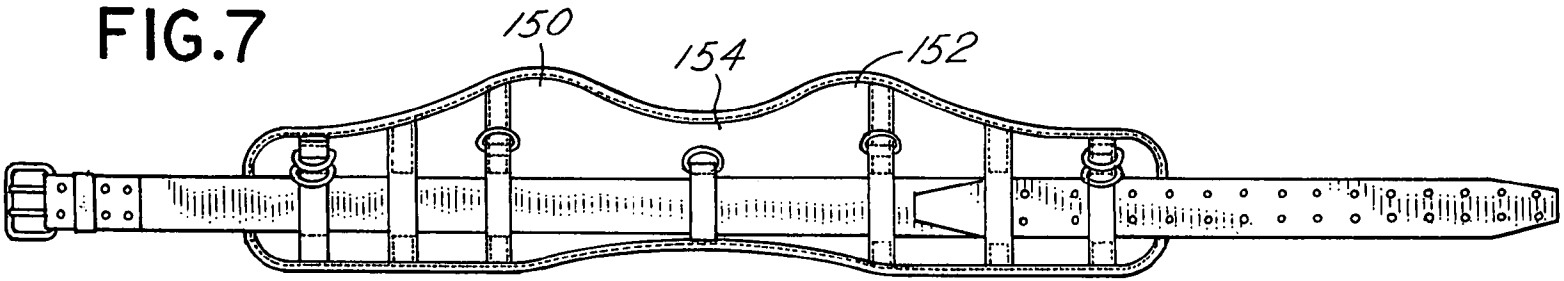
FIG. 7 is a plan view of the strap and belt construction of the carrier of FIGS. 5 and 6.
Figure 8:
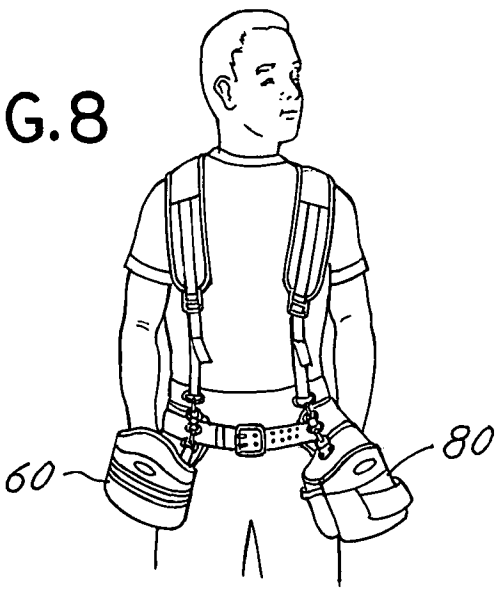
FIG. 8 is an isometric view of the tool carrier of FIG. 5 as worn by an individual.
Figure 9:
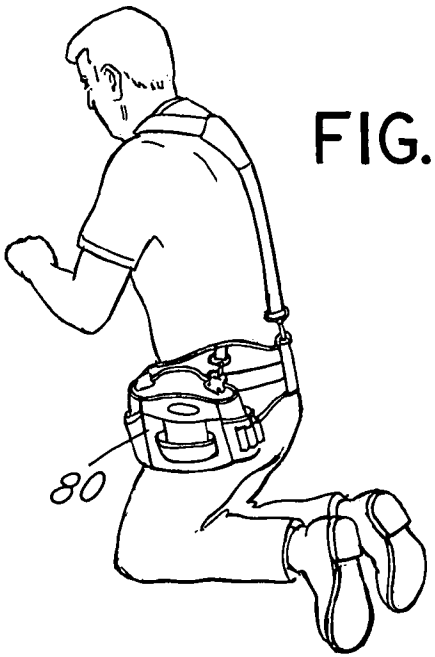
FIG. 9 is another isometric view of the tool carrier of FIG. 5 illustrating the manner of wearing the tool carrier.

As shown in FIG. 7, the back strap 66 is configured with a first left hand wide section 150 and a second right hand wide section 152 separated by an narrow spine section 154 to provide support for the region of the kidneys of an individual wearing the carrier with the narrow portion aligned with the spine of an individual. This provides additional comfort and support for the individual wearing or using the belt as depicted in FIGS. 8 and 9.

Figure 10:
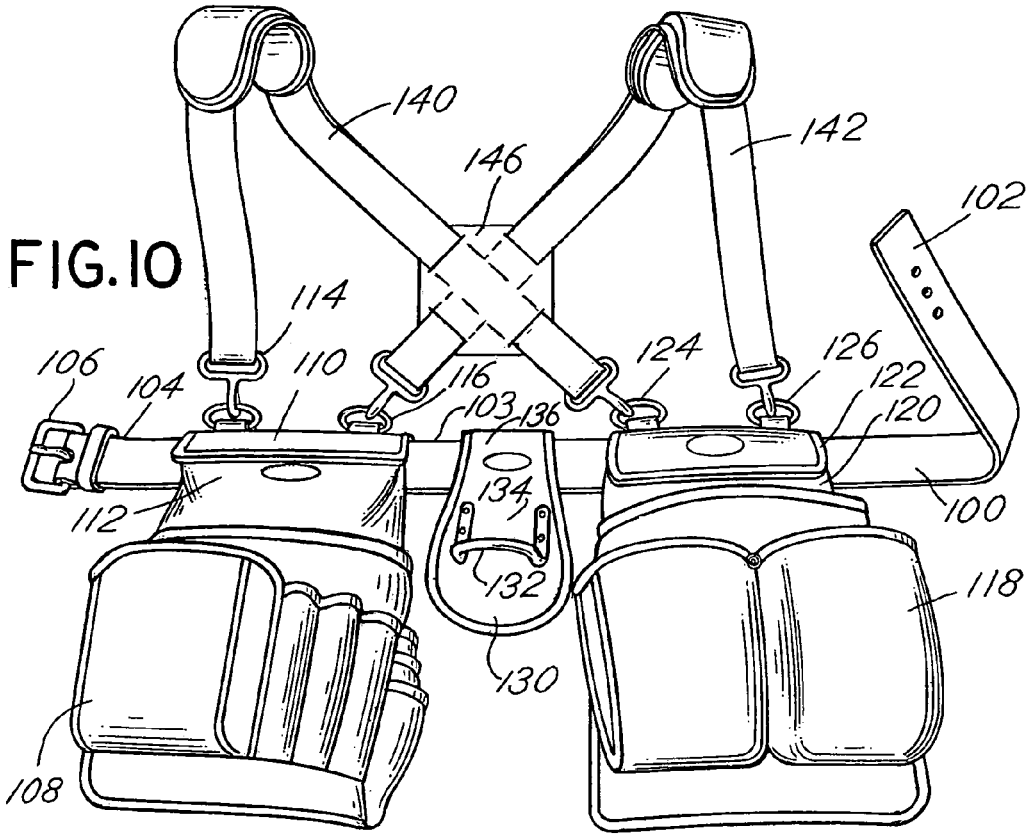
FIG. 10 is an isometric view of an alternative embodiment of a tool carrier including a belt with various pouches attached thereto and shoulder straps.

FIG. 10 illustrates a combination of pouches with a belt and a pair of shoulder straps. Thus, a belt 100 includes a first free end 102 and a second free end 104 which may be connected to one another by a belt buckle 106 when the belt 100 is fitted about the waist of a workman. A first pouch 108 includes a top edge or margin 110 having a formed fabric loop 112 so that the pouch 108 may receive the belt 100 through the loop 112. The top margin 110 further includes a first ring or connection element or metal buckle element 114 and a second, spaced connection element or metal buckle element 116 attached to the top margin 110. In a similar fashion, a second pouch 118 includes a fabric loop 120 formed along the top margin 122 thereof and further includes a ring or buckle element 124 and a second, spaced ring or buckle element 126. The belt 100 further includes a section 103 which, in the embodiment depicted, has attached thereto a tool carrier 130 which includes a metal loop 132 attached to a generally planar board member 134 having an upper fabric loop 136.

The pouch 108 is positioned or positionable to fit on the left hand side of a worker. The pouch 118 is positioned to sit on the right hand of a worker. The pouches 108 and 118 may slide along the belt 100 in order to be properly positioned on the opposite hips of a worker, for example, depending, of course, upon the size or girth of the worker and the position the worker desires to have the pouches 108 and 118 placed. In any event, the belt 100 may then be fastened about the waist of a worker and the buckle 106 will help retain the pouches 108, 118 on the worker.

Shoulder straps 140 and 142 further facilitate retention of the tool carrier by a workman. The straps 140 and 142 connect the metal loops or rings 114, 116, 124 and 126. Specifically, the left hand shoulder strap 140 connects a ring 114 with a ring 124. The right hand shoulder strap 142 connects ring 126 associated with pouch 118 to the ring 116 associated with the pouch 108. The straps 140 and 142 cross on the back side of a workman or worker. The straps 140 and 142 may also be attached or fixed or placed through a slot in a sheet 146 on the back side of a worker. The sheet 146 may include, for example, a cushion material in order to facilitate the comfort and the use of the tool carrier. Of course, the straps 140 and 142 may be omitted entirely from the described tool carrier. However, the straps 140 and 142 facilitate balancing and positioning of the pouches 108 and 118 by a worker and help distribute the weight on an individual utilizing the described tool carrier.

Figure 11A:
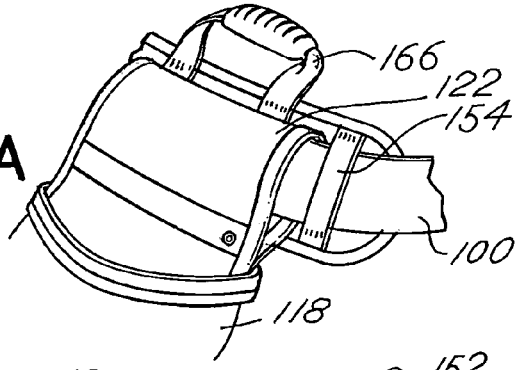
FIG. 11A is an enlarged isometric view of the detail of a pouch, belt and waist strap combination depicted in FIG. 11.
Figure 11:
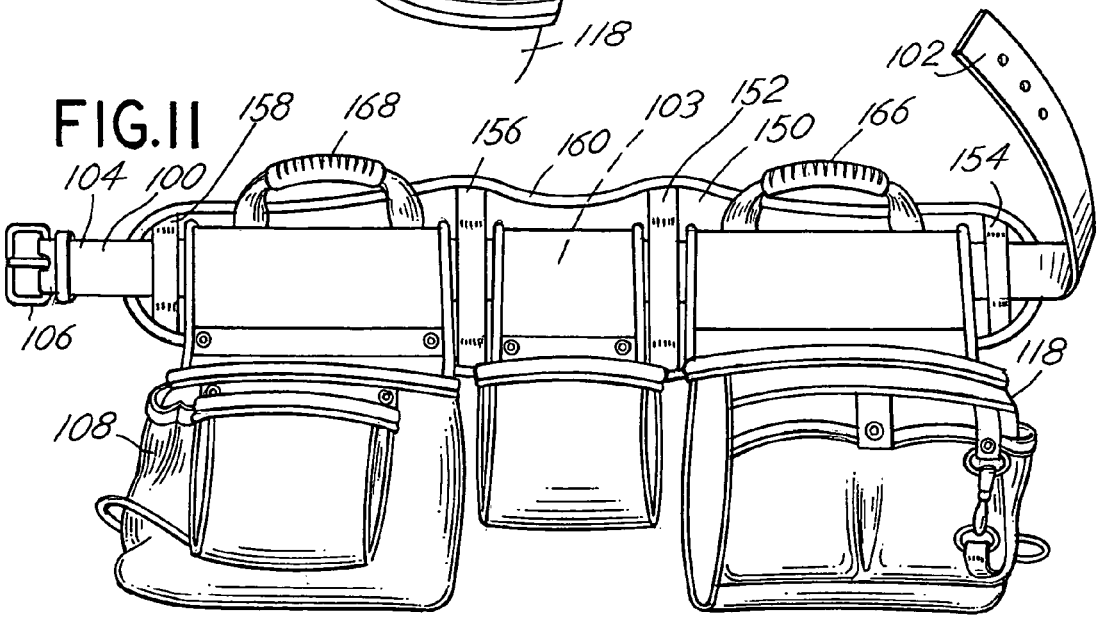
FIG. 11 is an isometric view of an alternative belt and pouch combination along with a waist strap.

FIGS. 11 and 11A illustrate some alternative features associated with a tool carrier generally of the type depicted in FIG. 10. The tool carrier of FIG. 11 includes a waist strap 150 having a plurality of attachment loops such as loops 152, 154, 156 and 158. The waist strap 150 includes an upper margin 160 which is configured so that the upper margin provides enhanced comfort, particularly in the lumbar area on the back side of an individual, substantially in the manner described with respect to other embodiments of the invention.

The waist strap 150 further includes a first handle 166 attached in the vicinity or in the region of the typical placement of the pouch 118, and a second handle 168 attached on the left side of the waist strap 150 as it would be used by a worker. The handles 166 and 168 are stitched or otherwise fixed to the waist strap 150. The waist strap 150 may then be folded, as may the belt 100, so that the handles 166 and 168 will overlie one another to enable the tools retained in the pouches 108 and 118 to be easily carried by a workman in a manner distinct from positioning the belt about the waist. FIG. 11A depicts the loop 122 formed along the upper margin of the pouch 118. It further depicts the manner in which the handle 166 may be stitched to the waist strap 150.

Figure 12A:
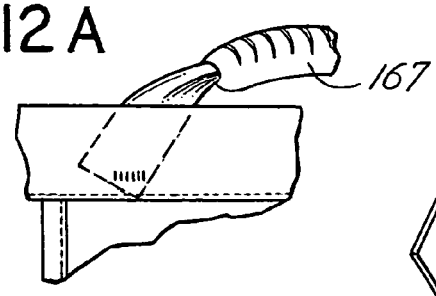
FIG. 12A is an enlarged isometric view of the attachment of the handle to a belt and/or pouch.
Figure 12:
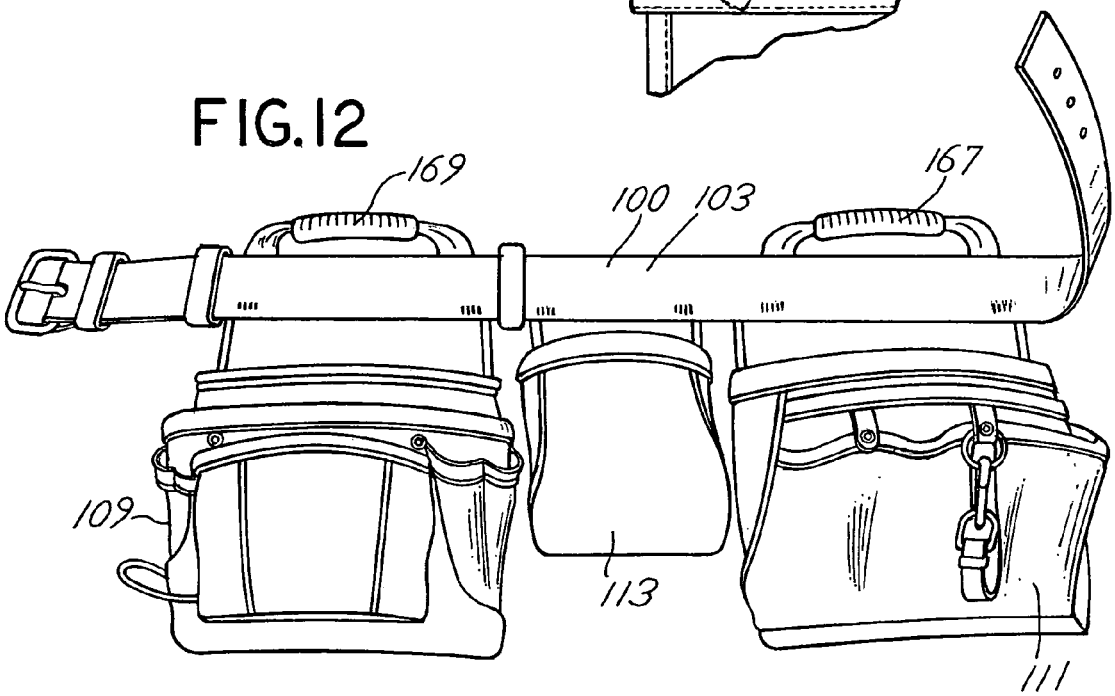
FIG. 12 illustrates a further alternative embodiment of a combination belt with pouches and further including handles attached to the belt which may be folded over one another for carrying of the pouches.

FIGS. 12 and 12A illustrate another embodiment of the invention wherein a belt 100 includes a first pouch 109 attached or stitched to the left hand side of the belt 100 and a second pouch 111 attached or stitched to the right hand side of the belt 100. A center pouch 113 is stitched generally to the midpoint section 103 of the belt 100. A first handle 167 is stitched to the belt 100 and a second handle 169 is stitched or otherwise attached to the left hand side of the belt 100. The handles 167 and 169 may be joined or folded one over the other as previously described so that the tool belt and pouches depicted in FIG. 12 may be easily carried. This is depicted in greater detail in FIG. 13 wherein the handles 167 and 169 are positioned adjacent or over one another so that they may be gripped together and carry the pouches 111, 114 and 109.

Figure 13:
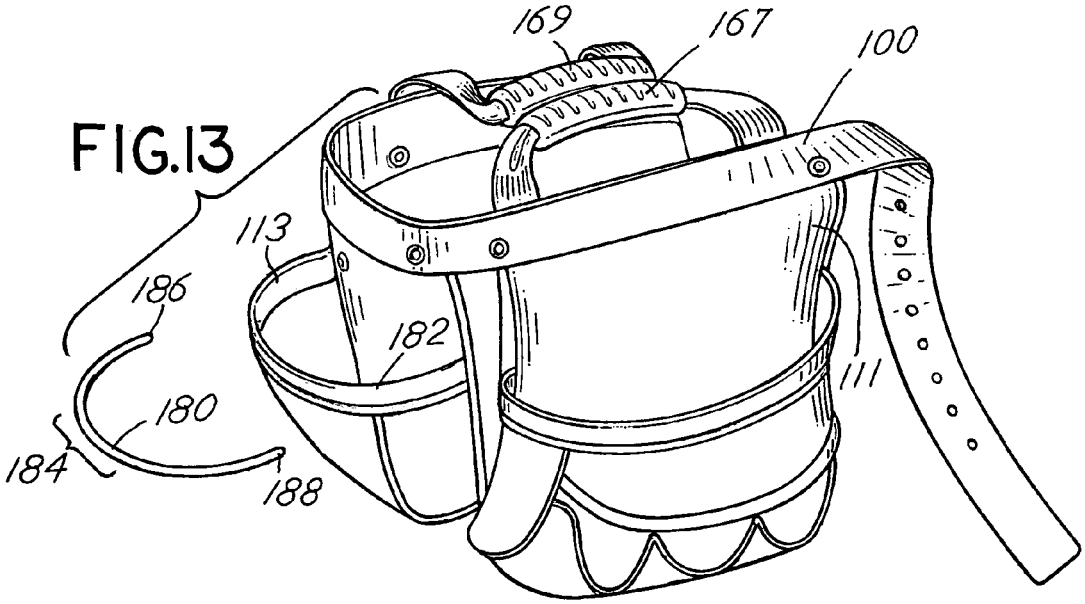
FIG. 13 is an isometric view of a combination belt and pouch construction generally of the type depicted in FIG. 11 wherein there is illustrated the construction of a pouch pocket designed to prevent articles within the pocket from falling out of the pocket and further depicting the manner in which the handles attached to the belt and/or a waist strap can be folded over one another in order to transport the belt and tools as a tool carrier.

FIG. 13 also illustrates another feature of the invention. That is, for example, the pouch 113 may include an internal wire or stiffening member 180 sewn into the upper margin 182 of the pouch 113. The internal wire or stiffening member 180 includes a middle section 184 and opposite ends 186, 188. The opposite ends 186 and 188 extend to the edges of the pocket or pouch 113. The middle section 184 is in an elevated or upper position relative to the ends when the pocket or pouch 113 does not contain any items or materials. Placement of tools or items in the pouch 113 will tend to cause the pouch 113 to distort or sag and move downwardly. The internal stiffening member or wire 180 will, however, tend to counteract this downward movement and retain the shape of the pocket or pouch 113. This construction or structure may be incorporated into any of the pouches depicted in the various drawings.

Figure 14:
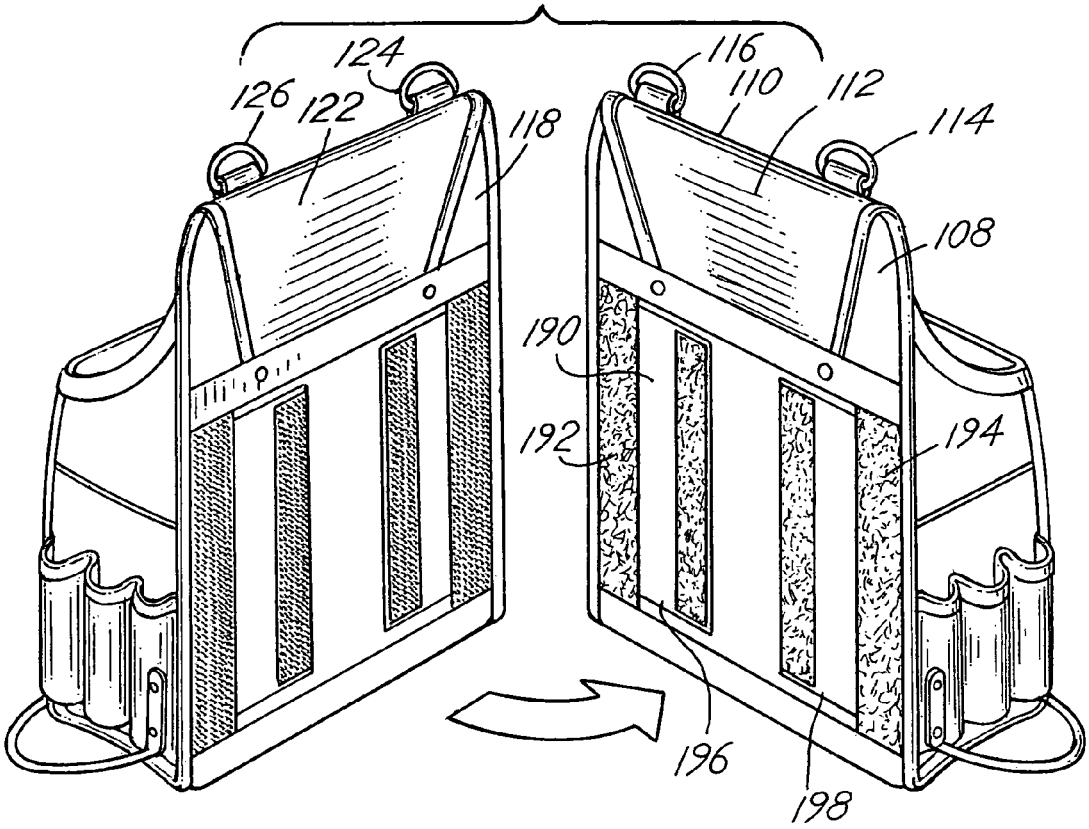
FIG. 14 is an isometric view depicting a pair of pouches of the type which may be attached to a tool carrier belt wherein the pouches are configured with a back side that includes a hook and loop construction for joining of two pouches together as a tool carrier.
Figure 15:
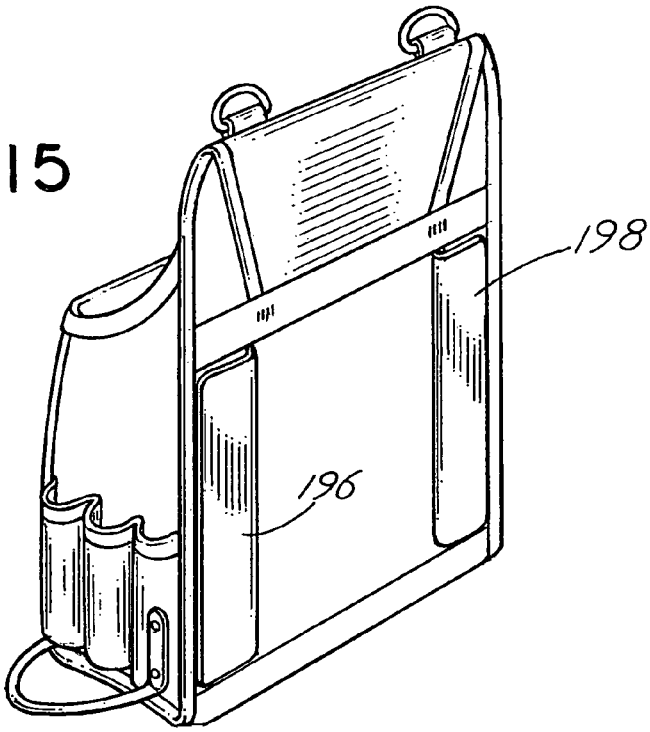
FIG. 15 is an isometric view of a singe pouch of the type depicted in FIG. 14 wherein the hook and loop elements are covered by a cover flap.

FIG. 14 illustrates another feature associated with the pouches that may be incorporated, for example, in the embodiment of FIG. 10 of the invention. The pouches, for example, pouch 108 and pouch 118 each include general planar backside panel, for example, panel 190 having a series of hook and loop strips 192 and 194 incorporated thereon on the inside of the back panel 190. A folding flap 196, a second folding flap 198 may be folded over the hook or loop sections 192 and 194, respectively, in the manner depicted, for example, in FIG. 15. This will preclude the hook and loop mechanism 192, 194 from being irritating or interfere with the use and attachment when on a belt. However, the pouches 108 and 118 may be joined back to back by engagement of the hook and loop elements 192 and 194, for example, in the manner depicted in FIG. 19. If so joined in the manner depicted in FIG. 19, the rings 114, 116, 124 and 126 will be aligned with one another so that a handle and carry strap 200 may be attached thereto. In particular the end buckle elements 202 and 204 may be attached to rings 114 and 124. The buckle element 204 can then join the rings 116 and 126. The strap 200 includes a handle 210. Alternatively, as depicted, for example, in FIG. 20, the strap 200 may include a shoulder pad 212. The strap 212 may be adjusted in length by adjustment of a slide adjustment mechanism 214. The strap 200 may be used in combination with a pair of pouches as depicted, for example, in FIG. 19 or with a single pouch, for example, as depicted in FIG. 20.

Figure 16:
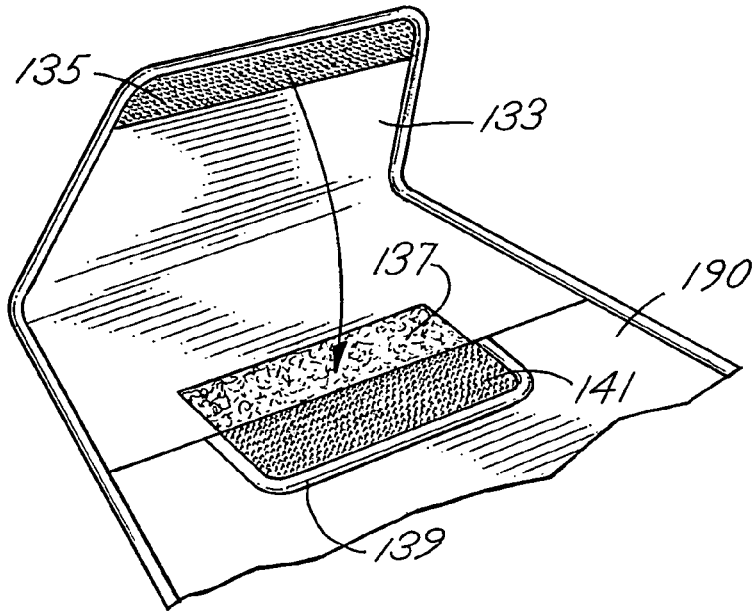
FIG. 16 is an isometric view of the loop construction associated with a pouch which utilizes a hook and loop construction.
Figure 17:
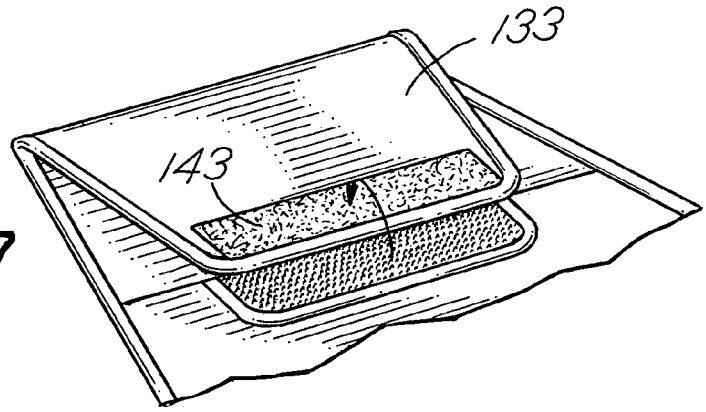
FIG. 17 is an isometric view of the construction of FIG. 16 wherein the flap of the loop is folded.
Figure 18:
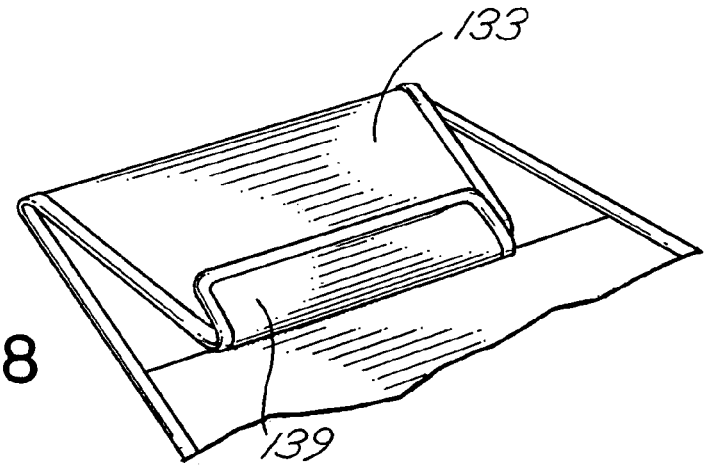
FIG. 18 is an isometric view depicting the final step in the formation of a pouch of the type depicted in FIGS. 16 and 17.
Figure 23:
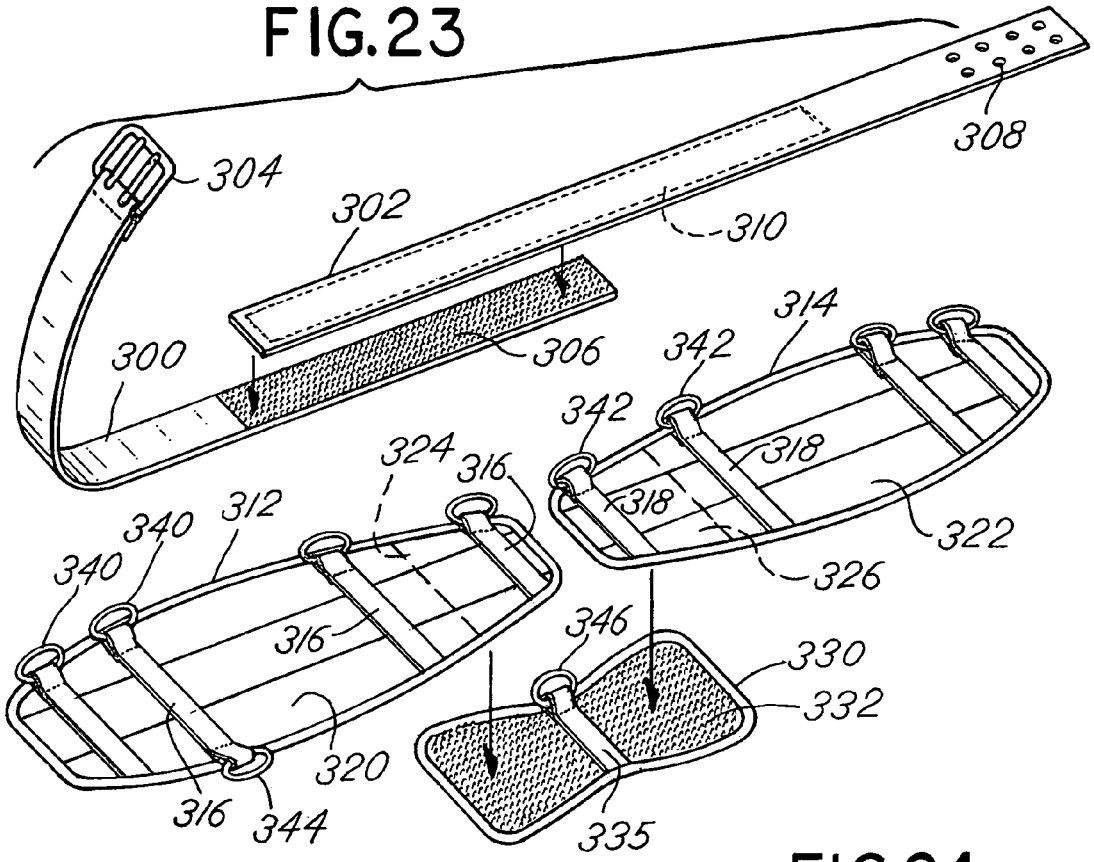
FIG. 23 is an exploded isometric view of an alternative embodiment of the invention.

Referring back to FIGS. 16-18 there is depicted by way of example the construction of the loop, for example, loop 112 depicted in FIG. 14 for the pouch 108. This construction of FIGS. 16-18 is an alternative to a riveted or stitched construction for the loop 112 in FIG. 14. Thus, the loop in FIG. 16 comprises a flap 133 having an inside surface with a hook or loop material 135 that cooperates with and will engage with a loop or hook material 137 on the backside or inside of a panel 190. A separate flap 139 includes a hook or loop material 141 and will engage with a loop or hook material 143 on the outside of the flap 133 to secure the loop as depicted in FIG. 18.

Referring next to FIGS. 21 and 22 there is depicted a special pouch or pocket construction associated with a pouch. As depicted in those figures, a lateral or side panel 230 of a pouch, for example, pouch 118 connects with a front side panel 232. The side panel 230 further is attached to an inclined panel section 234 of the lateral or side panel 230. The inclined section 234 inclines inwardly relative to the plane of the lateral or side panel 230. Thus, a series of tool pockets or sleeves 236, 238 and 240 affixed to the lateral or side panel 230 are adapted to receive the shaft of tools, for example, screwdrivers. The shafts will extend through the hollow or tubular pockets 236, 238, 240 downwardly and will not be caused to engage or interfere with a lateral side panel 230 and more particularly the inclined section 234 of the lateral side panel 230. This will provide ease of placement of the tools having those shafts into and out of the pocket 236, 238 and 240. As depicted in FIG. 21, the lateral side panel 230 may also include a metal loop 242 attached thereto and more particularly to the side edges 244 and 246 of the lateral or side panel 230 for holding a handle or other similar headed tool, for example.

Referring now to FIGS. 23-26, there is illustrated yet a further embodiment of the invention. In particular, a tool belt is comprised of a first strap section 300 and a second strap section 302. The first strap section 300 includes a buckle element 304 at one end and a hook and loop mechanism 306 on a facing or side thereof at the opposite end. The second belt element or strap section 302 includes belt buckle openings 308 at one end and a hook and loop mechanism 310 on a facing or surface at its opposite end for cooperation with the hook and loop mechanism of the first strap 300. The hook and loop mechanisms 310 and 306 enable adjustment of the combined length of the straps 300 and 302 as they are joined together to thereby accommodate the waist or girth of a workman. The tool belt is thus adjustable due to the interaction of the hook and loop mechanism associated with the separate straps 300 and 302.

The belt comprised of the straps 300 and 302 cooperatively engages with tool pads and hip pads such as pad 312 and pad 314. Each of the pads 312 and 314 include a series of belt loops, for example, belt loops 316 associated with pad 312 and belt loops 318 associated with pad 314. The straps 300 and 302, when joined together, may be fitted through the belt loops 316 to hold the pads 312 and 314 in a desired position, for example, on the hips of a workman. The pads 312 and 314 include an outer face 320 and 322, respectively. An inner face on the opposite side from the outer faces 320 and 322 may include a hook and loop section, such as the section 326 for the pad 314 and the section 324 for the pad 312. The combination may further include a lumbar pad, such as lumbar pad 330 which includes a facing or surface 332 comprised of a hook and/or loop mechanism cooperative with the hook and/or loop mechanism 324 and/or 326 of the pads 312 and 314. Finally, the lumbar pad 330 may include a loop 335 which will act as a belt loop to further facilitate maintaining the lumbar pad in a desired position for use by a worker. Thus, the lumbar pad 320 may be appropriately positioned against the lumbar region or spine of a worker and the side pads or hip pads 312 and 314 appropriately adjusted on straps 300, 302 to accommodate positioning about the girth or waist of a worker utilizing the tool belt construction of the invention.

Figure 24:
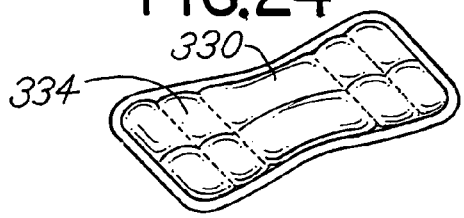
FIG. 24 is an isometric view of the reverse side of the lumbar pad associated with the belt construction of FIG. 23.

As depicted in FIG. 24 the lumbar pad 330 may also be padded on its opposite side 334 or the side fitted against the back of a user. This functions to ease pressure on the lumbar area.

The lumbar pad 330, as well as the side support pads 312 and 314 may include a series of rings, for example, rings 340 associated with pad 312 and 342 associated with pad 314 along one edge or side of the elongate pad 312 and/or 314. A second set of rings, for example, ring 344 may be arrayed along the bottom edge of the pad 312. Similar second rings may be provided for the pad 314. Likewise, a support ring 346 may be provided for the lumbar pad. The rings are provided for attachment of pouches as depicted in various prior figures. The pouches are designed to contain or store tools and the like. Further, the rings may be utilized for attachment of shoulder straps or suspenders which facilitate holding a tool belt on its user.

Figure 25:
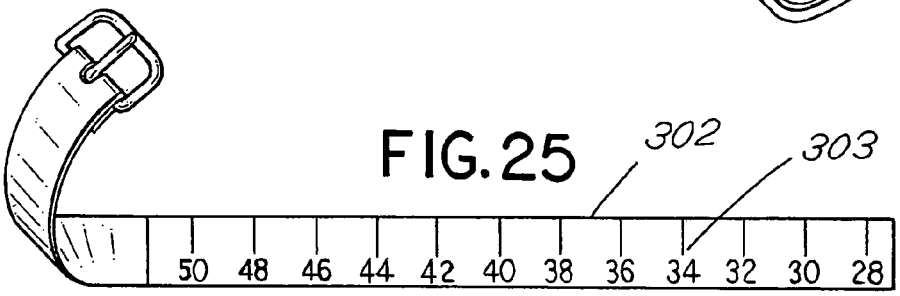
FIG. 25 is an isometric view illustrating the indicia utilized to measure or guide the size of the belt construction of the embodiment of FIG. 23.
Figure 26:
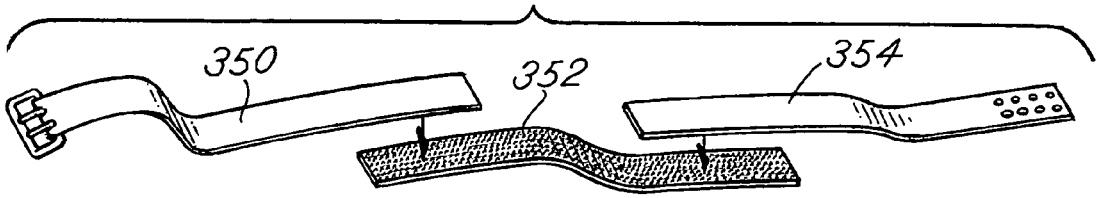
FIG. 26 illustrates various embodiments of the belt construction of the general type illustrated in FIG. 23.

FIGS. 25 and 26 illustrate some additional features that may be associated with the adjustable length belt comprised of straps, for example, straps 300 and 302. The strap 302 depicted in FIG. 25 may include indicia, for example, indicia 303 which are associated with a girth size and in combination with the second strap 302 will enable a worker or user of the system to easily adjust the size of the belt to accommodate that worker's needs.

As another alternative, the belt may be comprised of more than a pair of straps. For example, as illustrated in FIG. 26, three straps 350, 352 and 354 are provided. The straps utilize hook and loop facings and may be interconnected to provide for an elongate belt. The interconnection mechanism is preferably a hook and loop mechanism. It should be noted, however, that various other connection mechanisms such as snaps, clips or the like may be utilized to connect the belt strap members 350, 352 and 354 together as well as straps 300, 302.

It is possible to vary the constructions without departing from the spirit and scope of the invention. Thus the straps may all be adjustable. The buckles and connectors may be of any various types. The pouches may be attachable or detachable or integrally incorporated in the strap. The subject matter of the invention is therefore to be limited only by the following claims and equivalents thereof.

What is claimed is:

1. A tool carrier comprising, in combination:

a belt including a back with a midpoint, a first free end for placement around the left-hand side of a person and second free end for placement around the right-hand side of a person, a lower margin and an upper margin, and a belt buckle connector for connecting the first and second free ends of the belt;

a first pouch attached to said belt, said first pouch including a first upper side with a first belt receiving loop extending upwardly along the first upper side, said first pouch supported by the first belt receiving loop on said belt, said first pouch including an access opening thereto below the lower margin of said belt, said first pouch positioned to rest on the left hip of a person;

a second pouch attached to said belt, said second pouch including a second upper side with a second belt receiving loop extending upwardly along the second upper side, said second pouch supported by the second belt receiving loop, said second pouch including an access opening thereto below the lower margin of the belt and positioned to rest on the right hip of a person, said first and second belt receiving loops of said first and second pouches each including an upper side edge with a pair of spaced buckles attached to said respective upper side edges; and first and second shoulder straps for fitting respectively over the left and right shoulder of an individual, said first shoulder strap attached between one of said spaced buckles of the first belt loop of the first pouch to one of said spaced buckles of the second belt loop of the second pouch, said second strap attached between the other one of said spaced buckles of the second belt loop of the second pouch and the other one of said spaced buckles of the first belt loop of the first pouch whereby said first and second shoulder straps are crossed over one another.

2. The carrier of claim 1 including multiple pockets in each pouch.

3. The carrier of claim 1 wherein the length of at least one shoulder strap is adjustable.

4. The carrier of claim 1 including a detachable clip for attachment of the straps to the buckles.

5. The carrier of claim 1 wherein at least one pouch includes said access opening thereto as an open top with an upper edge reinforced by an arcuate stiffening member.

6. The carrier of claim 1 wherein the pouches include a generally flat, planar inside face, and an outside face with a tool pocket, said inside faces including gripping means for joining the inside facers together back to back.

7. The carrier of claim 1 wherein at least one of said first and second belt loops includes an attached handle along said upper side edge thereof.

8. The carrier of claim 1 wherein the said belt loops each include a handle attached along said upper side edge thereof.

9. The carrier of claim 1 wherein the first and second pouches each include a generally flat planar inside face with a gripping means for joining said inside faces.

10. The carrier of claim 9 wherein the said belt loops each include a handle along said upper side edge thereof.

* * * * *